US010556325B2

(12) United States Patent
Cheney et al.

(10) Patent No.: US 10,556,325 B2
(45) Date of Patent: Feb. 11, 2020

(54) RATCHETING CLAMP

(71) Applicants: Gary Cheney, Coon Rapids, MN (US); Linda Cheney, Coon Rapids, MN (US)

(72) Inventors: Gary Cheney, Coon Rapids, MN (US); Linda Cheney, Coon Rapids, MN (US)

(73) Assignee: Gary A. Cheney, Coon Rapids, MN (US)

( * ) Notice: Subject to any disclaimer, the term of this patent is extended or adjusted under 35 U.S.C. 154(b) by 133 days.

(21) Appl. No.: 15/993,578

(22) Filed: May 30, 2018

(65) Prior Publication Data

US 2019/0366514 A1 Dec. 5, 2019

(51) Int. Cl.
*B25B 5/16* (2006.01)

(52) U.S. Cl.
CPC ..... *B25B 5/163* (2013.01); *B25B 5/16* (2013.01)

(58) Field of Classification Search
CPC .. B25B 5/16; B25B 5/08; B25B 5/085; B25B 5/068; B25B 5/163
See application file for complete search history.

(56) References Cited

U.S. PATENT DOCUMENTS 4,884,836 A * 12/1989 Maye ..... B66C 1/48 294/101
6,220,589 B1 * 4/2001 Smith, III ..... B25B 5/003 269/133
6,658,711 B1 * 12/2003 Benson ..... B25B 5/068 269/3
2011/0227357 A1 * 9/2011 Bourque ..... B25B 5/08 294/164

* cited by examiner

*Primary Examiner* — Daniel J Colilla

(57) ABSTRACT

An improved ratcheting clamp is a clamp with an improved design for clamping and holding work pieces to be joined together at 90 degrees or other angles such as in welding or carpentry operations, by handling the clamp with one hand and allowing the free hand to handle the work pieces instead of requiring two hands to operate the clamp. The clamp uses a cam and torsion spring to keep constant pressure of one work piece against the other work piece.

12 Claims, 6 Drawing Sheets

RATCHETING CLAMP

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of clamps and more specifically relates to an improved ratcheting clamp.

2. Description of the Related Art

An F-clamp, also known as a bar clamp or speed clamp is a type of clamping tool for pressing at least two different objects or work pieces together for gluing, welding, fastening, or for various other kinds of work. The name comes from its "F" shape. The F-clamp is similar to a C-clamp in use, but has a wider opening capacity. This tool is most often used in woodworking while a more permanent joining of the wood pieces is being made using screws and/or glue. In the case of metalworking, it is used to hold at least two pieces together until it can be welded or bolted. Various sizes and lengths of bar clamps are manufactured to accommodate different lengths of wood or metal to be joined and make the task of joining more precise while providing greater ease and convenience. Even still, holding the pieces together while attempting to operate the clamp can be difficult for one person to do, and quite often requires the help of another person, if the work pieces are long and cumbersome. It generally takes two hands to operate the clamp and additional hands to hold the work pieces in place until clamped. An easier solution is needed.

Various attempts have been made to solve the above-mentioned problems such as those found in U.S. Pat. No. 5,222,420 to Joseph A. Sorensen et al; U.S. Pat. No. 6,568,667 to John R. Hall; and U.S. Pat. No. 5,826,310 to Harold W. Hobday. This art is representative of bar clamps. None of the above inventions and patents, taken either singly or in combination, is seen to describe the invention as claimed.

Ideally, a bar clamp should provide ease of use and one handed operation, and yet, would operate reliably and be manufactured at a modest expense. Thus, a need exists for a reliable improved ratcheting clamp to avoid the above-mentioned problems.

BRIEF SUMMARY OF THE INVENTION

In view of the foregoing disadvantages inherent in the known clamp art, the present invention provides a novel improved ratcheting clamp. The general purpose of the present invention, which will be described subsequently in greater detail, is to provide a ease of use and one handed operation to join work pieces together.

An improved ratcheting clamp preferably comprises an elongated ratchet bar including a proximal end section with a plurality of spaced teeth thereon forming a ratchet rack, a distal end section, a center section, a gripping cam including a plate member, a gripping panel connected to the plate member in a substantially perpendicular orientation, a cam member pivotally connected to the plate member and spaced from the gripping panel such that when in use a piece of material can be removably gripped by the gripping cam, and a spring member connected between the plate member and the cam member that is adapted to bias the cam member toward the gripping panel.

The gripping cam is attached to the distal end section of the elongated ratchet bar. The ratcheting member includes a main body having a ratchet channel adapted to slidably receive the proximal end section of the elongated ratchet bar. A ratchet handle for operating the ratcheting member includes a ratchet pawl member adapted to releasably engage respective spaced teeth of the ratchet rack of the elongated ratchet bar. The ratchet handle is pivotally connected to the main body so that during successive pivoting motions of the ratchet handle the ratchet pawl engages successive teeth of the ratchet rack of the elongated ratchet bar to thereby successively pull the elongated ratchet bar through the ratchet channel to pull the gripping cam toward the ratcheting member.

A compression plate is connected to the ratcheting member in a substantially perpendicular orientation such that when in use a piece of material can be placed against the compression plate in a substantially perpendicular orientation to the piece of material held by the gripping cam. When in use, the piece of material held by the gripping cam can be releasably held in place against the piece of material being held against the compression plate. The gripping panel and the cam member include an outer layer of rubber material thereon adapted such that material held by the gripping cam is not damaged by the gripping cam.

The ratcheting member further includes a release button connected to the ratchet handle that is adapted to move the ratchet pawl member from engagement with the plurality of spaced teeth of the ratchet rack of the elongated ratchet bar such that the material being held in place by the improved ratcheting clamp can be readjusted or removed.

The gripping cam and the compression plate are both formed having a substantially flat rectangular contact surface. The substantially flat rectangular contact surface of the gripping cam and the compression plate further include a V-shaped notch adapted to accommodate and more securely hold pieces of material having a circular cross-section. The cam member of the gripping cam is formed having an oblong cross-section and the elongated ratchet bar is formed having a rectangular cross-section.

The compression plate includes a plurality of apertures adapted to allow fasteners to be inserted therethrough for attaching together the pieces of material held by the gripping cam and the compression plate. The spring member may be formed as a torsion spring. The ratchet handle is formed having an elongated shape adapted to be pivotally attached and oriented parallel to the elongated ratchet bar. The gripping cam further includes an adjustment screw adapted to adjust the connection point between the cam member and the plate member and thereby the distance between the cam member and the gripping panel. The gripping panel of the gripping cam includes an outer layer of knurled material thereon adapted such that pieces of steel material can be held more securely thereto.

The present invention holds significant improvements and serves as an improved ratcheting clamp. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, an improved ratcheting clamp, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a clamp device and more particularly to an improved ratcheting clamp as used to improve the ease of use and one handed operation in joining work pieces together.

Generally speaking, an improved ratcheting clamp is a clamp with an improved design for clamping and holding work pieces to be joined together at 90 degrees or other angles such as in welding or carpentry operations, by handling the clamp with one hand and allowing the free hand to handle the work pieces instead of requiring two hands to operate the clamp. The clamp uses a cam and torsion spring to keep constant pressure of one work piece against the other work piece.

Figure 1A:
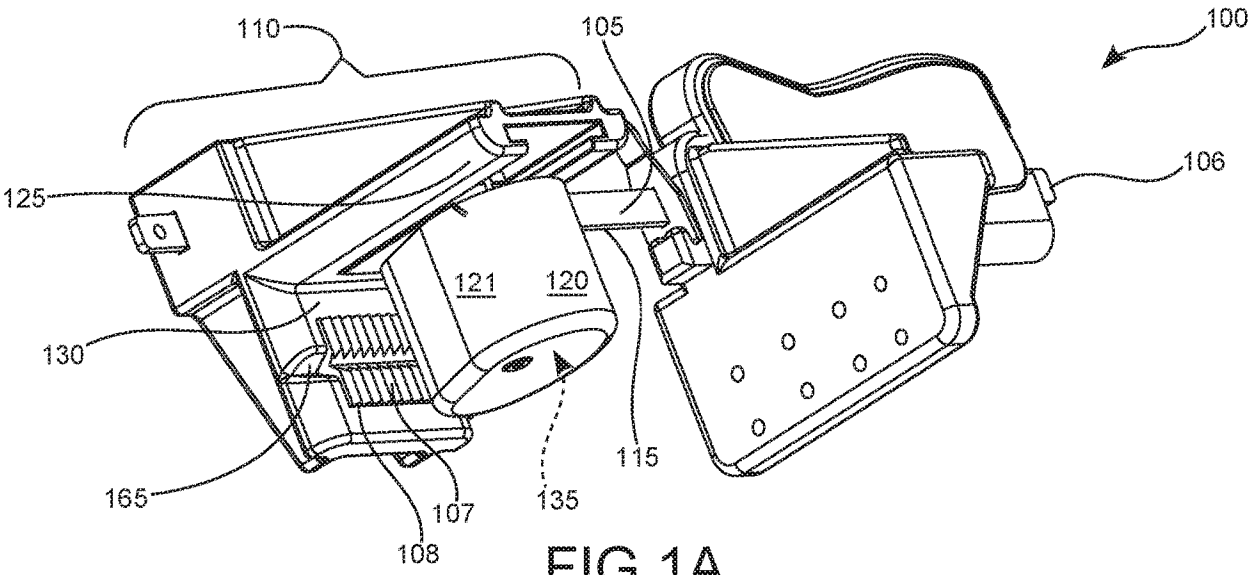
FIG. 1A shows a distal end perspective view illustrating an improved ratcheting clamp according to an embodiment of the present invention.

Referring to the drawings by numerals of reference there is shown in FIG. 1A, shows a distal end perspective view illustrating an improved ratcheting clamp according to an embodiment of the present invention.

Improved ratcheting clamp 100 preferably comprises elongated ratchet bar 105 including proximal end section 106 with a plurality of spaced teeth 107 thereon forming ratchet rack 108, distal end section 110, center section 115, gripping cam 120 including plate member 125, gripping panel 130 connected to plate member 125 in a substantially perpendicular orientation, cam member 121 pivotally connected to plate member 125 and spaced from gripping panel 130 such that when in use piece of material 155 can be removably gripped by gripping cam 120, and spring member 135 connected between plate member 125 and cam member 121 that is adapted to bias cam member 121 toward gripping panel 130.

Figure 1B:
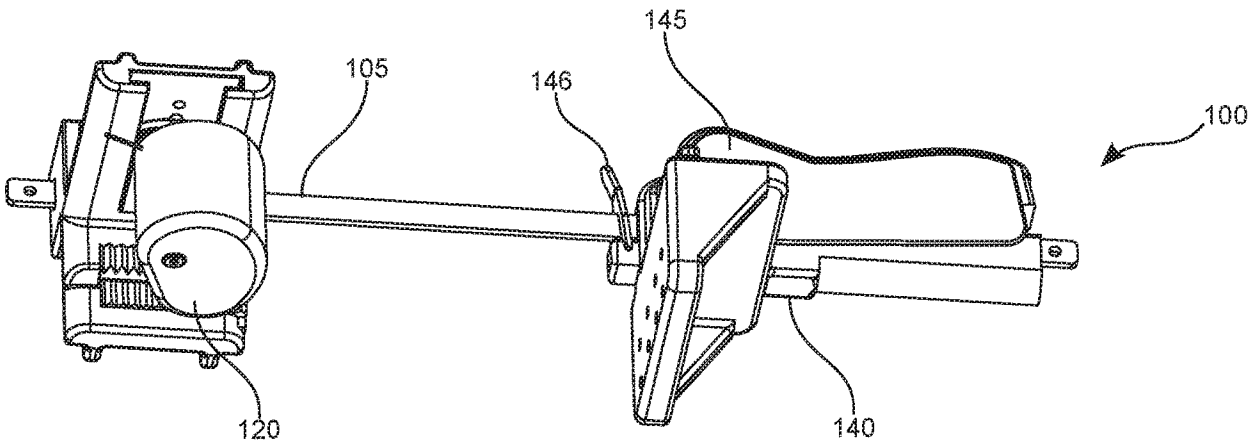
FIG. 1B is a side perspective view illustrating the improved ratcheting clamp according to an embodiment of the present invention of FIG. 1.

Referring now to FIG. 1B, is a side perspective view illustrating the improved ratcheting clamp according to an embodiment of the present invention of FIG. 1.

Figure 2:
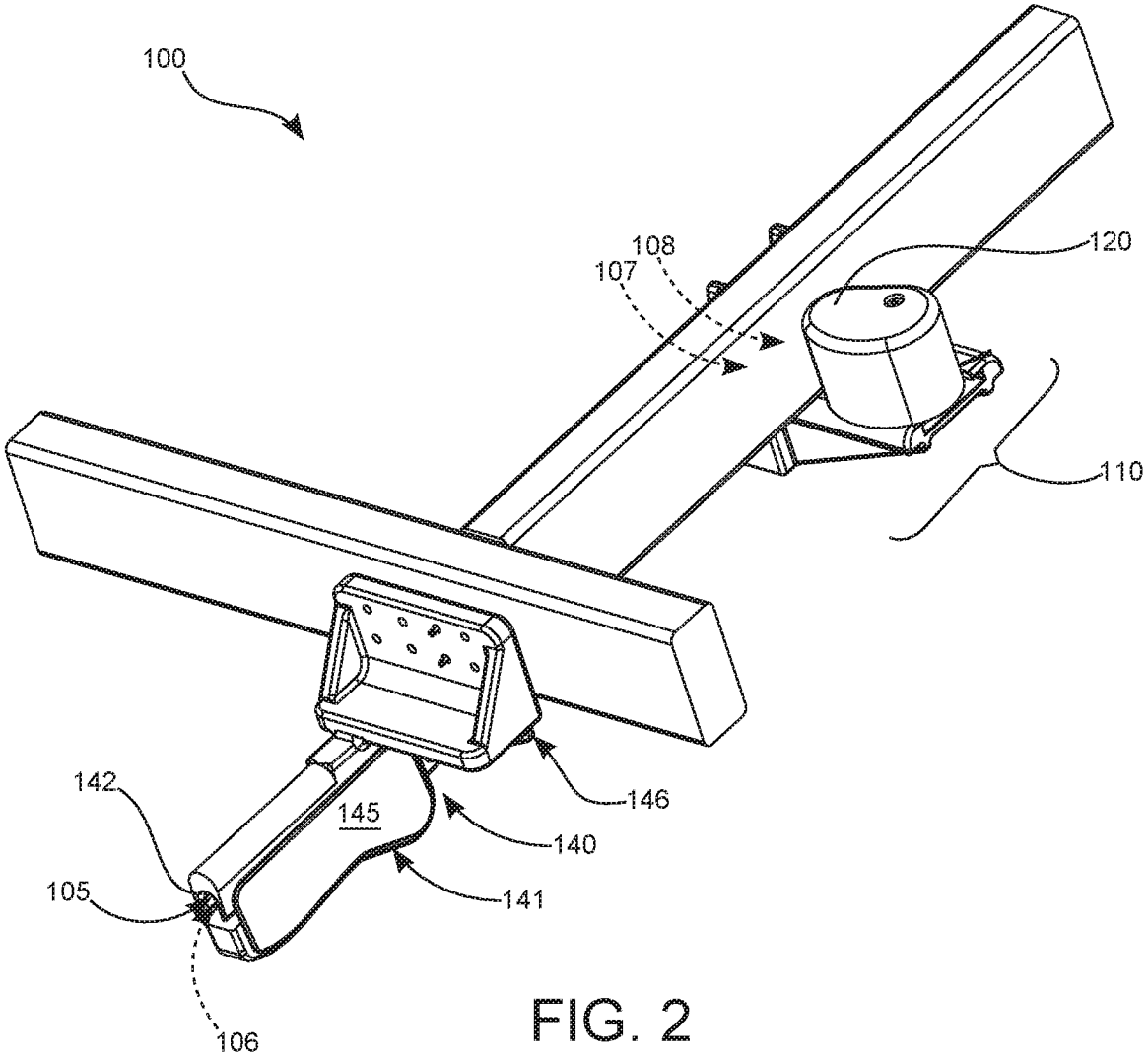
FIG. 2 is a proximal end perspective view illustrating the improved ratcheting clamp according to an embodiment of the present invention of FIG. 1.

Improved ratcheting clamp 100 has a specially designed, spring loaded gripping cam 120 attached to the end of elongated ratchet bar 105 which slides through ratcheting member 140 of improved ratcheting clamp 100. Spring loaded gripping cam 120 is able to slide down over work piece 155, as seen in FIG. 2, such as the narrow side of a 2×4 or over other various sizes and shapes of wooden work pieces 155, and allows a single user to efficiently pull it tightly against the mating piece 155 via ratcheting member 140 until a permanent attachment can be made. The permanent attachment may be gluing, fastening with screws or nails, or welding in the case of metal work pieces 155.

Referring now to FIG. 2, is a proximal end perspective view illustrating the improved ratcheting clamp according to an embodiment of the present invention of FIG. 1.

Gripping cam 120 is attached to distal end section 110 of elongated ratchet bar 105. Ratcheting member 140 includes main body 141 having ratchet channel 142 adapted to slidably receive proximal end section 106 of elongated ratchet bar 105. Ratchet handle 145 for operating ratcheting member 140 includes ratchet pawl member 146 adapted to releasably engage respective spaced teeth 107 of ratchet rack 108 of elongated ratchet bar 105. Ratchet handle 145 is pivotally connected to main body 141 so that during successive pivoting motions of ratchet handle 145, ratchet pawl member 146 engages successive teeth 107 of ratchet rack 108 of elongated ratchet bar 105 to thereby successively pull elongated ratchet bar 105 through ratchet channel 142 to pull gripping cam 120 toward ratcheting member 140.

Figure 3A:
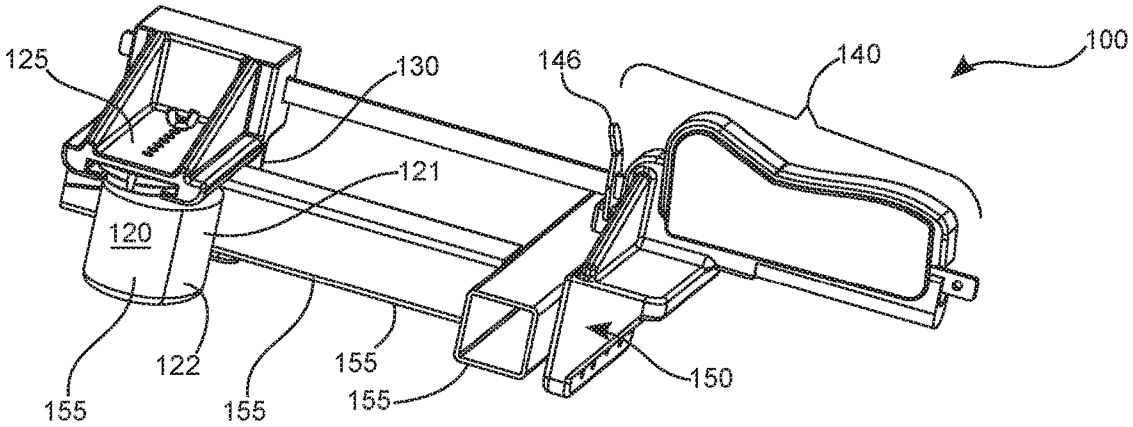
FIG. 3A is a bottom perspective view illustrating the improved ratcheting clamp according to an embodiment of the present invention of FIG. 1.

Referring now to FIG. 3A, is a bottom perspective view illustrating the improved ratcheting clamp according to an embodiment of the present invention of FIG. 1.

Plate member 125 is connected to ratcheting member 140 in a substantially perpendicular orientation such that when in use piece of material 155 can be placed against compression plate 150 in a substantially perpendicular orientation to piece of material 155 held by gripping cam 120. When in use, piece of material 155 held by gripping cam 120 can be releasably held in place against piece of material 155 being held against compression plate 150. Gripping panel 130 and cam member 121 include an outer layer of rubber material 122 thereon, better seen in FIG. 3B, adapted such that piece of material 155 held by gripping cam 120 is not damaged by gripping cam 120.

Figure 3B:
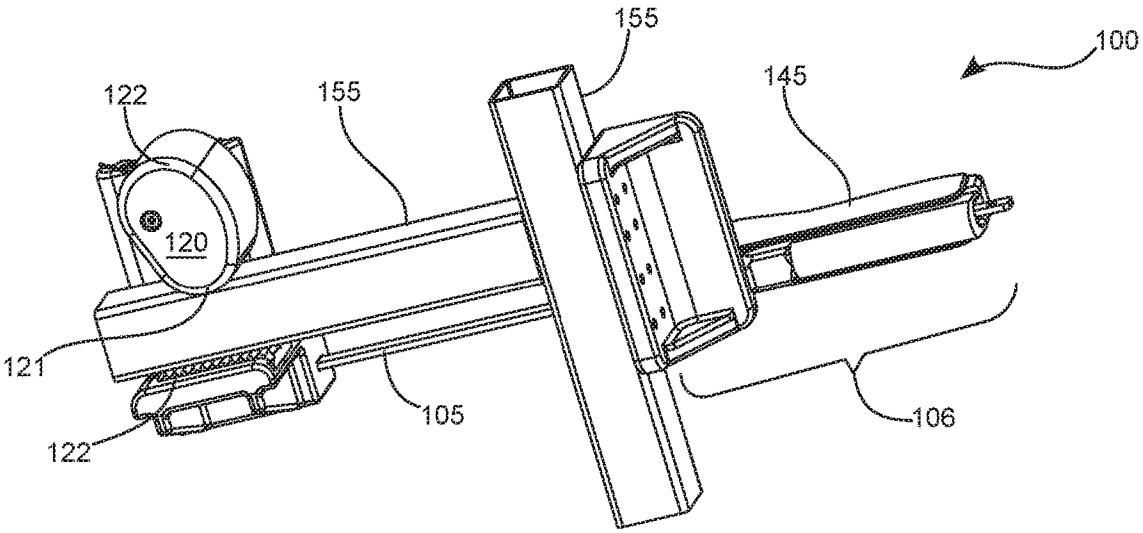
FIG. 3B is a top perspective view illustrating the improved ratcheting clamp according to an embodiment of the present invention of FIG. 1.

Referring now to FIG. 3B, is a top perspective view illustrating the improved ratcheting clamp according to an embodiment of the present invention of FIG. 1.

While improved ratcheting clamp 100 is ideal for various types of joints, it is especially ideal for making "T" joints such as perpendicularly joining one stud 155 to a middle portion of another stud 155. Proximal end section 106 of improved ratcheting clamp 100 preferably has a one-handed squeeze mechanism to ratchet elongated ratchet bar 105 through the hand portion of improved ratcheting clamp 100, drawing cam member 121 closer to the hand portion or proximal end section 106 while pressing the two work pieces 155 together more tightly. Cam member 121 may be held back while sliding cam member 121 over the wood 155, but may also be used one handed to push gripping cam 120 down while pushing away to open cam member 121 until it slides over work piece 155 and then ratchet handle 145 end is lowered onto work piece 155 and ratchet handle 145 is squeezed using the same hand to pull pieces of material 155 together. The one handed operation sets the improved ratcheting clamp 100 apart from all other clamps.

Figure 4A:
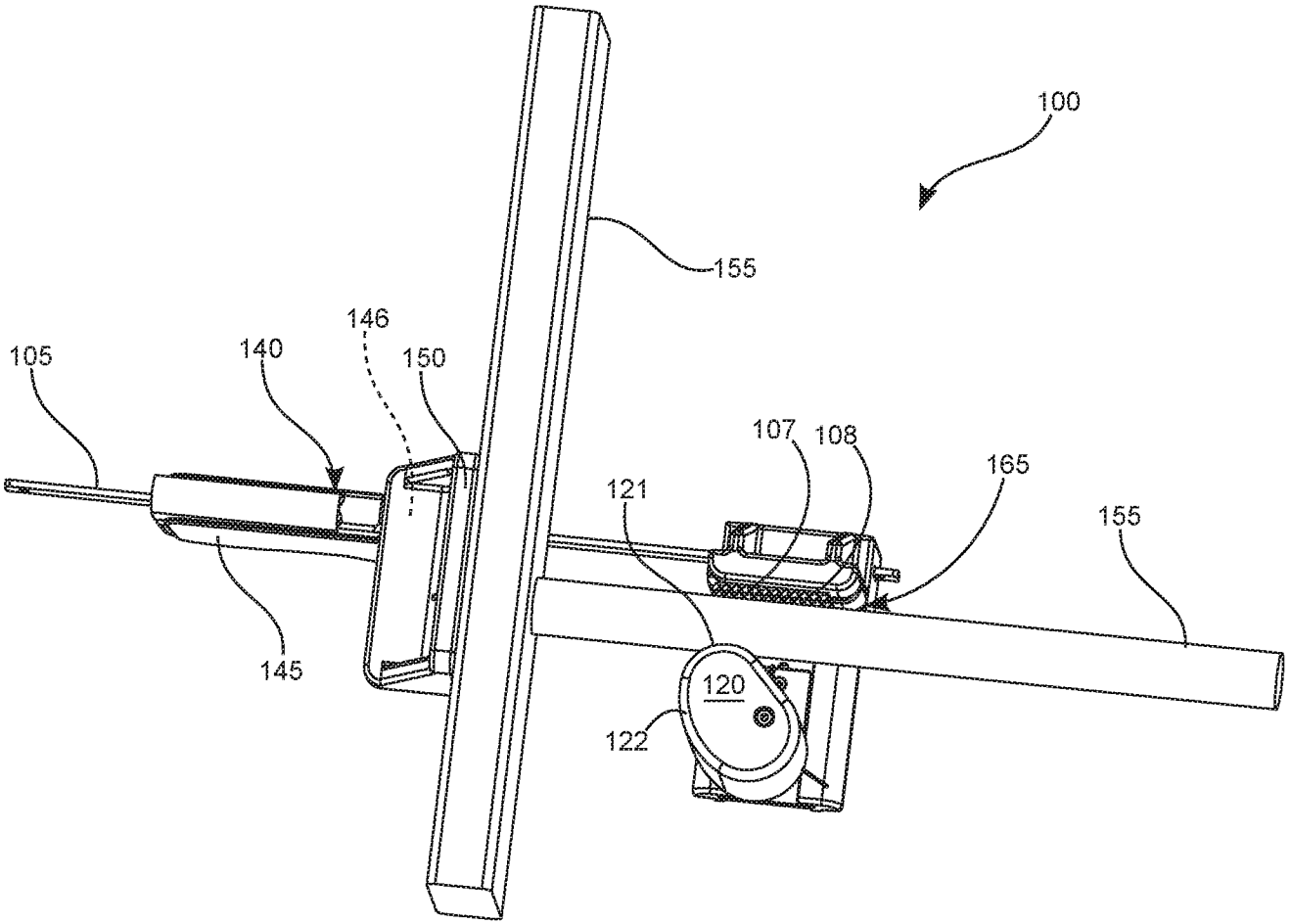
FIG. 4A is a top perspective view illustrating the improved ratcheting clamp according to an embodiment of the present invention of FIG. 1.

Referring now to FIG. 4A, is a top perspective view illustrating the improved ratcheting clamp according to an embodiment of the present invention of FIG. 1.

Ratcheting member 140 further includes release button 146 mounted in front of ratchet handle 145 (as seen in FIG. 1B) that is adapted to move ratchet pawl member 146 from engagement with the plurality of spaced teeth 107 of ratchet rack 108 of elongated ratchet bar 105 such that piece of material 155 being held in place by improved ratcheting clamp 100 can be readjusted or removed.

Figure 4B:
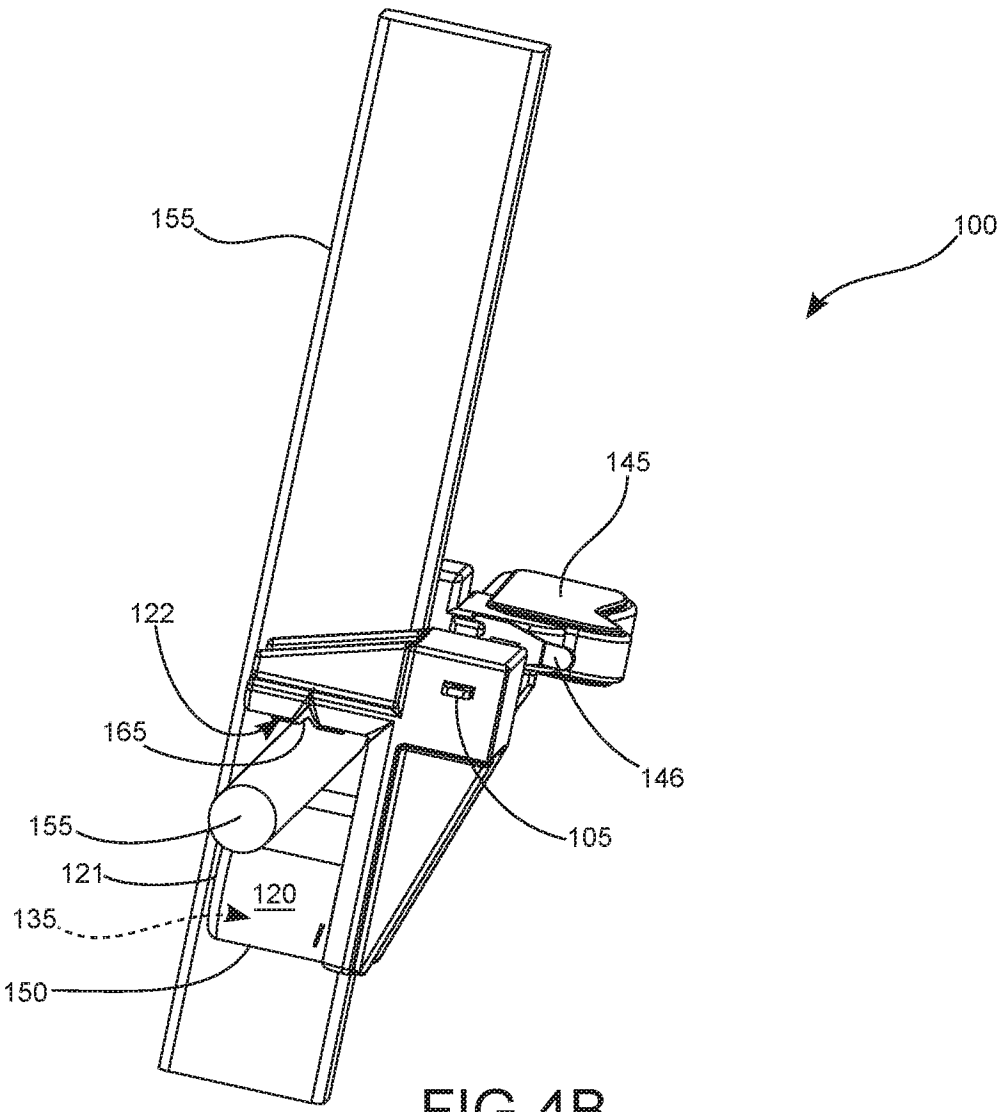
FIG. 4B is a distal end perspective view illustrating the improved ratcheting clamp according to an embodiment of the present invention of FIG. 1.

Gripping cam 120 and compression plate 150 are both formed having a substantially flat rectangular contact surface. The substantially flat rectangular contact surface of gripping cam 120 and compression plate 150 further include v-shaped notch 165, seen best in FIGS. 1A and 4B, are adapted to accommodate and more securely hold pieces of material 155 having a circular cross-section. Cam member 121 of gripping cam 120 is formed having an oblong cross-section and elongated ratchet bar 105 is formed having a rectangular cross-section.

Referring now to FIG. 4B, is a distal end perspective view illustrating the improved ratcheting clamp according to an embodiment of the present invention of FIG. 1.

Spring member 135 loaded cam member 121 allows the user to rock back cam member 121 until cam member 121 portion of clamp 100 is able to be slid down over piece of material 155, and then just let go and cam member 121 self-grips piece of material 155 so that the user need only be concerned with the other end of improved ratcheting clamp 100. The benefit is that one individual can now do what it normally takes two people to do, saving time and labor costs. Release button 146 allows the user to remove improved ratcheting clamp 100 with one hand. Rubber material 122 on the contact surfaces of improved ratcheting clamp 100 prevent marring of delicate pieces of material 155. The device can be used for joining cabinet pieces, doing framework, or joining pieces of material 155 of various shapes or configurations and for holding while doweling, gluing, bolting, or screwing the pieces together.

Improved ratcheting clamp 100 can be made in many different sizes and configurations for various purposes. For instance, a heavy duty improved ratcheting clamp 100 of a larger size can be used for heavier work pieces 155 such as when working with steel. Improved ratcheting clamp 100 can also be of various sizes for working with wood pieces. It may also be configured to join work pieces 155 together on different planes.

Figure 5:
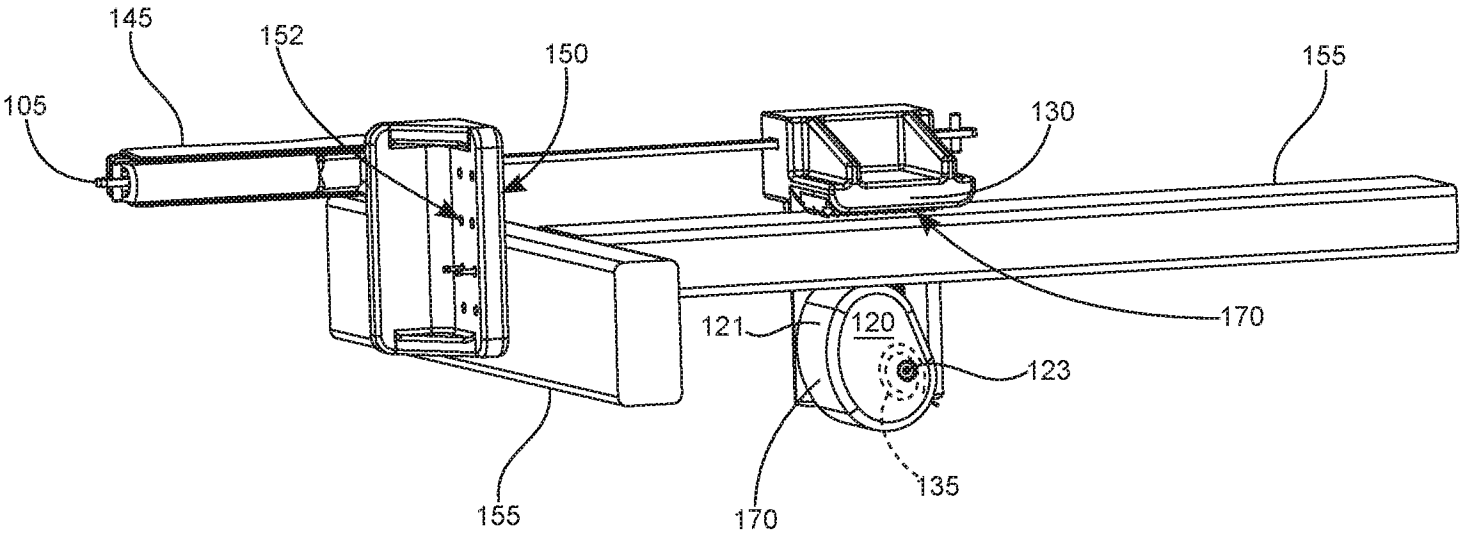
FIG. 5 is a top perspective view illustrating the improved ratcheting clamp according to an embodiment of the present invention of FIG. 1.

Referring now to FIG. 5, is a top perspective view illustrating the improved ratcheting clamp according to an embodiment of the present invention of FIG. 1.

Compression plate 150 includes a plurality of apertures 152 adapted to allow fasteners to be inserted therethrough for attaching together piece of material 155 held by gripping cam 120 and compression plate 150. Spring member 135 may be formed as a torsion spring member 135. Ratchet handle 145 is formed having an elongated shape adapted to be pivotally attached and oriented parallel to elongated ratchet bar 105. Gripping cam 120 further includes adjustment screw 123 adapted to adjust the connection point between cam member 121 and plate member 125 and thereby the distance between cam member 121 and gripping panel 130. Gripping panel 130 of gripping cam 120 may include an outer layer of knurled material 170 thereon adapted such that pieces of steel material 155 can be held more securely thereto.

Improved ratcheting clamp 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other components or arrangements such as, for example, including more or less components, customized parts, different color combinations, parts may be sold separately, etc., may be sufficient.

Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. An improved ratcheting clamp comprising:

an elongated ratchet bar including:

a proximal end section including:

a plurality of spaced teeth thereon forming a ratchet rack;

a distal end section; and a center section;

a gripping cam including;

a plate member;

a gripping panel;

wherein said gripping panel is connected to said plate member in a substantially perpendicular orientation;

a cam member;

wherein said cam member is pivotally connected to said plate member and spaced from said gripping panel, such that when in use a piece of material can be removably gripped by said gripping cam; and a spring member;

wherein said spring member is connected between said plate member and said cam member and is adapted to bias said cam member toward said gripping panel;

wherein said gripping cam is attached to said distal end section of said elongated ratchet bar;

a ratcheting member including:

a main body including:

a ratchet channel;

wherein said ratchet channel is adapted to slidably receive said proximal end section of said elongated ratchet bar; and a ratchet handle including:

a ratchet pawl member;

wherein said ratchet pawl member is adapted to releasably engage respective said plurality of spaced teeth of said ratchet rack of said elongated ratchet bar;

wherein said ratchet handle is pivotally connected to said main body;

wherein during successive pivoting motions of said ratchet handle said ratchet pawl engages successive teeth of said ratchet rack of said elongated ratchet bar to thereby successively pull said elongated ratchet bar through said ratchet channel, to thereby pull said gripping cam toward said ratcheting member; and a compression plate;

wherein said compression plate is connected to said ratcheting member in a substantially perpendicular orientation thereto, such that when in use a piece of material can be placed against said compression plate in a substantially perpendicular orientation to said piece of material held by said gripping cam;

wherein when in use said piece of material held by said gripping cam can be releasably held in place against said piece of material being held against said compression plate.

2. The improved ratcheting clamp of claim 1, wherein said gripping panel and said cam member include an outer layer of rubber material thereon adapted such that material held by said gripping cam is not damaged by said gripping cam.

3. The improved ratcheting clamp of claim 1, wherein said ratcheting member further includes a release lever located in front of said ratchet handle and is adapted to move said ratchet pawl member from engagement with said plurality of spaced teeth of said ratchet rack of said elongated ratchet bar, such that said material being held in place by said improved ratcheting clamp can be readjusted or removed.

4. The improved ratcheting clamp of claim 1, wherein said gripping cam and said compression plate are both formed having a substantially flat rectangular contact surface.

5. The improved ratcheting clamp of claim 4, wherein said substantially flat rectangular contact surface of said gripping cam and said compression plate further include a V-shaped notch therein adapted to accommodate and more securely hold pieces of material having a circular cross-section.

6. The improved ratcheting clamp of claim 1, wherein said cam member of said gripping cam is formed having an oblong cross-section.

7. The improved ratcheting clamp of claim 1, wherein said elongated ratchet bar is formed having a rectangular cross-section.

8. The improved ratcheting clamp of claim 1, wherein said compression plate includes a plurality of apertures therethrough adapted to allow fasteners to be inserted therethrough for attaching together said pieces of material held by said gripping cam and said compression plate.

9. The improved ratcheting clamp of claim 1, wherein said spring member is formed as a torsion spring.

10. The improved ratcheting clamp of claim 1, wherein said ratchet handle is formed having an elongated shape adapted to be pivotally attached and oriented parallel to said elongated ratchet bar.

11. The improved ratcheting clamp of claim 1, wherein said gripping cam further includes an adjustment screw adapted to adjust the connection point between said cam member and said plate member and thereby the distance between said cam member and said gripping panel.

12. The improved ratcheting clamp of claim 1, wherein said gripping panel of said gripping cam includes an outer layer of knurled material thereon adapted such that pieces of steel material can be held more securely thereto.

* * * * *